United States Patent [19]

MacKinnon, Jr. et al.

[11] Patent Number: 4,471,592

[45] Date of Patent: Sep. 18, 1984

[54] STRAPPING BAND FOR RETAINING INSULATION BETWEEN WALL STUDS AND METHOD OF MANUFACTURE AND USE

[76] Inventors: Donald J. MacKinnon, Jr., 1109 Main St., Cotuit, Mass. 02635; Richard P. Crowley, 152 Ice Valley Rd., Osterville, Mass. 02655

[21] Appl. No.: 448,599

[22] Filed: Dec. 10, 1982

[51] Int. Cl.[3] ..... E04B 1/74

[52] U.S. Cl. ..... 52/404; 52/361; 52/712; 52/743

[58] Field of Search ..... 52/404, 406, 407, 408, 52/508, 507, 712, 743, 98, 99, 369, 366, 361, 378, 735, 696, 741, 746; 411/461, 466; 16/16

[56] References Cited

U.S. PATENT DOCUMENTS

| | | | |
|---|---|---|---|
| 830,494 | 9/1906 | Collins | 52/735 |
| 936,167 | 10/1909 | Rittler | 52/696 |
| 960,197 | 5/1910 | Pridle | 52/696 |
| 1,027,425 | 5/1912 | Makowski | 52/696 |
| 1,247,933 | 11/1917 | Colpitts | 411/466 |
| 1,810,597 | 6/1931 | Corwin | 52/700 |
| 1,915,697 | 6/1933 | Robinson | 52/696 |
| 2,109,520 | 3/1938 | Awbrey | 52/704 |
| 2,239,394 | 4/1941 | MacKechnie | 52/508 |
| 2,275,109 | 3/1942 | McGee | 52/696 |
| 3,466,825 | 9/1969 | Guddal | 52/408 |
| 4,023,323 | 5/1917 | Fortin | 52/404 |

FOREIGN PATENT DOCUMENTS

| | | | |
|---|---|---|---|
| 563833 | 3/1923 | France | 52/369 |
| 305520 | of 1933 | Switzerland | 411/466 |
| 332674 | of 1935 | Switzerland | 411/466 |

*Primary Examiner*—John E. Murtagh
*Assistant Examiner*—Andrew Joseph Rudy
*Attorney, Agent, or Firm*—Richard P. Crowley

[57] ABSTRACT

A metal strapping band to support flexible insulation within a wall cavity between spaced-apart wall studs, which strapping band comprises an elongated, metal strapping band having a plurality of uniformly spaced-apart lines of weakness therein extending from and adjacent at least one edge thereof, to define a plurality of defined tab elements in the plane of the band, which tab elements may be bent outwardly from the plane of the metal band, to form a support for flexible insulation to be secured within the wall cavity between the wall studs, the insulation supported by securing the metal strapping band to and across the wall studs, and bending outwardly the defined tab elements and impaling the flexible sheet material on the bent tab elements.

17 Claims, 3 Drawing Figures

STRAPPING BAND FOR RETAINING INSULATION BETWEEN WALL STUDS AND METHOD OF MANUFACTURE AND USE

BACKGROUND OF THE INVENTION

In the construction of a building, such as a residential, commercial or industrial building, such buildings require the installation of dry wall and typically insulation. The dry-wall sheets are normally secured to a plurality of upright wall studs, either wooden or metal, extending in a spaced-apart relationship in a plane along a defined wall, while insulation of a defined width or thickness, such as fiberglass, Styrofoam or other sound or heat insulation, is normally installed between the wall studs. Where the insulation, such as batts of fiberglass, for example, often secured on at least one side to a paper sheet, such as an aluminum sheet, or on both sides, is installed in the wall cavity between the studs, such insulation tends to sag and fall, unless secured in an upright position. Thus, such flexible-type insulation, on installation, often does not remain in its original position inside the wall cavity, but sags or falls, leading to a loss of heat or sound insulation in the exposed area.

One prior-art method of securing insulation in a secured, upright position between the wall studs is the employment of a metal strapping band secured to one side of the metal wall studs and containing an arrow-like tab projection within the center of the metal band. In use, the installer bends the arrow-like tab from the center of the strapping material, after the strapping material has been secured to the wall studs. The arrow-like end of the tab material is then impaled on the insulation, to maintain the insulation firmly in place in the wall cavity; thus, avoiding sagging of the insulation and the loss of sound or heat. Typically, such metal banding material is secured to the metal fasteners through the use of nails with wooden studs or self-tapping screws for metal U-channel studding. The metal bands are installed generally about 6 inches down from the top of the metal studding, which defines the wall cavity and holds the insulation, and typically every 4 feet horizontally, so that there are at least one or two arrow-pronged tabs extending outwardly into the wall cavity at the upper portion of each wall cavity.

The use of centrally disposed tabs, disposed in a metal strapping to form prongs before the securing and anchoring of spacing devices in concrete, is, for example, shown in U.S. Pat. No. 979,628, while strips used for spacing and holding building members in place are shown, for example, in U.S. Pat. No. 3,390,494. However, all of these prior-art methods, which employ a centrally disposed tab adapted to be bent into position, require the preforming of the tab within the central area of the metal strapping in defined locations, and do not provide the flexibility required for the variety of problems faced during construction. Further, in connection with the arrow-prong-type metal strapping, such metal strapping is typically secured to one side of a U-channel metal studding, through the employment of self-tapping screws. In practice, however, it has been found that such metal studding is usually spaced apart, for example, a short distance from an exterior wall, such as, for example, 3 to 9 inches, and, therefore, the placing of the screws and the securing of the metal strapping to the exterior wall surface of the metal studding are difficult, since the installer has limited space in which to employ a hammer or a screw gun.

Therefore, an improved metal-strapping article, suitable for use in retaining insulation within a wall cavity in a vertical position, which also provides for ease in securing the metal strapping to the wall studding, and which metal band is easily manufactured, is desirable.

SUMMARY OF THE INVENTION

The invention relates to a strapping band suitable for use in retaining insulation in an upright position within a cavity, and to the method of supporting such insulation. In particular, the invention concerns a metal strapping band which is secured to metal studding and which permits the support of flexible insulation in the wall cavity inbetween the studding, and to a method of securing the metal strapping band to the studding.

The metal strapping band of the invention is adapted to be secured to wall studs, either wooden walls studs or more particularly metal wall studs, having a U-channel sectional shape, which wall studs form therebetween a wall cavity suitable for the application of a wallboard, the wall cavity defined by an exterior or interior wallboard on the studs and adapted for the installation or heat or sound insulation-type material, particularly batt-type fiberglass, Styrofoam board and semirigid, flexible and rigid foam or other material, which is required to be held in an upright position within the wall cavity. The metal strapping band of the invention is fabricated of light-gauge metal, typically 10 to 20 gauge, usually of galvanized metal, and may be employed in walls, ceilings and other installations in new and existing buildings, existing brick walls and cement-block walls, to retain insulation in a desired position. The metal strapping band may be attached to existing walls or framings, by the use of appropriate fasteners, such as adhesives, self-tapping screws and nails, but more particularly is suitable for use with metal studding, such as usually employed in the office or commercial-construction field, wherein the metal studding is placed apart about 24 inches, and fits into metal tracks on the ceiling and the floor base. The metal strapping band of the invention is secured particularly to such U-channel-type metal studding in an easy and efficient manner, particularly where the metal studs are located close to a wall, such as an exterior wall, which makes it difficult to secure the metal strapping directly to one side of the metal studding, due to space limitations.

The improved strapping band of the invention is characterized by a plurality of lines of weakness therein extending generally angularly and inwardly from an adjacent at least one edge thereof, to define a plurality of typically uniformly spaced tab elements in the plane of the metal strapping band. The line of weakness may be occasioned by perforations or other techniques which will make the defined tab element bent easily outwardly from the plane of the strapping band, typically at a 90-degree angle, so as to retain insulation thereon. In one embodiment, the lines of weakness extend angularly, so as to provide for a tab portion which is pointed, when bent along the lines of weakness from the strapping band, and particularly when the lines of weakness extend at an angle of, for example, 30 to 45 degrees from the edge of the band to form bent, triangular tabs. The lines of weakness should extend inwardly a short distance, typically not over 50% of the width of the strapping band, to weaken the band. The lines of weakness and, therefore, the plurality of tabs defined may extend uniformly on one or the other side, or both sides, or alternately on either side.

In another embodiment, the defined tab may not be angular, but may be blunt, such as in a rectangular or square shape. This permits some flexibility in that the installer may use metal tin snips to cut the square either into a pointed shape or any other shape desired. Generally, the lines of weakness extend parallel to each other and inwardly a short distance from each edge of the strapping band. Generally also, it is desirable to have a plurality of tabs at regular intervals; for example, from 3 to 6 inches, so that the defined tab portions may not be employed only to uphold insulation in the wall cavity, but also may be used with metal studding to wrap around one side of the U-channel studding and to retain the metal band in a horizontal position across the metal studs, as hereinafter described.

In use, the metal strapping band of the invention is employed as a method for supporting insulation in an upright position in a wall cavity, which wall cavity is defined between at least two, spaced-apart, vertically upright wall studs, typically U-channel metal studs, which define the vertical, upright, rectangular wall cavity. The metal strapping band is secured to one side of each of the wall studs and extends horizontally thereacross, typically a defined short distance from the top of the ceiling. Where wood studs are employed, the strapping band is secured by nails or screws. However, where metal studding is provided and the distance between the one side of the metal studding and an exterior or other wall limits space requirements, then the defined tabs may be bent out of the plane and wrapped around one side of the U-channel metal studs, to retain the strapping band in a horizontal position, without the need to place a hammer or a screw drill behind the metal studding. In use, the installer tears a defined band along the line of weakness, cuts the tab where required, and bends outwardly the defined tab portion, with generally at least two tabs being bent outwardly at each wall cavity and generally perpendicular to the horizontally placed, metal strapping band. The insulation then may be impaled upon the two, outwardly extending, pointed tab sections, to support the insulation in the wall cavity.

Thus, the metal strapping band of the invention and the method of installation and use is particularly applicable to its use with U-channel-type metal studdings, both to retain the metal strapping band in a horizontal position through the use of defined tabs and also to employ such tabs to support insulation in the wall cavity.

The invention will be described for the purpose of illustration only in connection with certain embodiments; however, it is recognized that those persons skilled in the art may make various changes, modifications and improvements therein, all without departing from the spirit and scope of the invention.

DESCRIPTION OF THE EMBODIMENTS

Figure 1:
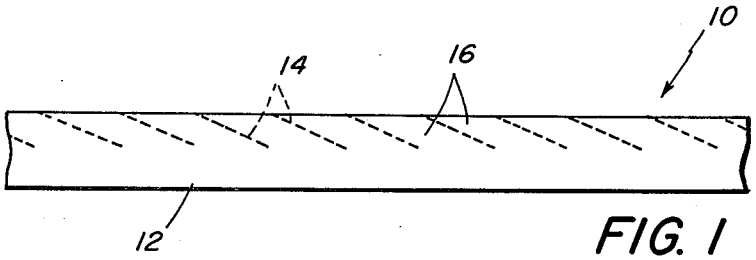
FIG. 1 is a plan view of the metal strapping band of the invention.

FIG. 1 shows a metal strapping band 10 of the invention comprising a light-gauge, galvanized metal band 12, having in the upper sections a purality of generally parallel, perforated, angular lines of weakness 14, to define a plurality of generally angular tab sections 16. The angular lines of weakness 14 extend inwardly from the outer edge at an angle of 30 degrees and generally inwardly to about 50% of the strapping-band material 12, so as to define a tab portion, for example, having base sections of about 1 to 2 inches along the line of bending shown by dotted lines.

Figure 2:
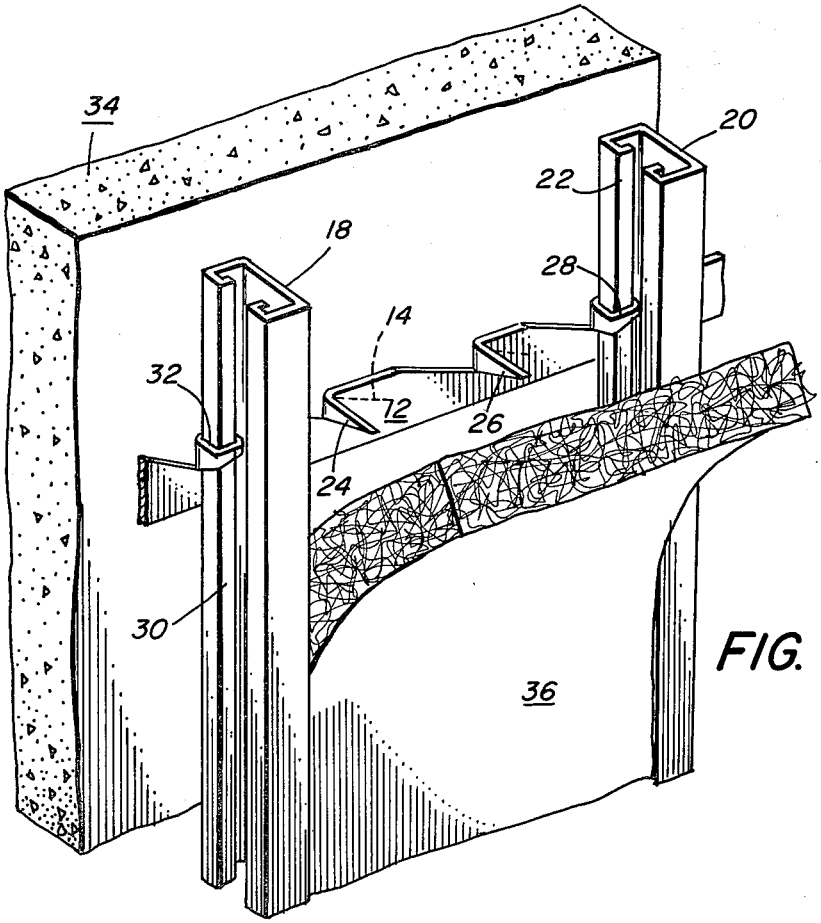
FIG. 2 is a schematic illustration of a perspective view of the metal strapping band installed between metal studs and ready to support insulation in the wall cavity.

FIG. 2 is a schematic, perspective illustration showing the band material 12 secured a short distance; for example, 4 to 12 inches, from the top of two metal U-channel-type metal studs 18 and 20 on one side thereof and secured thereto, by the bending of an angular tab portion 28 and 32 from the strapping band 12 about a generally L-shaped portion 22 and 30 of the metal studs 18 and 20, to secure the metal band 12 in a generally horizontal position against one exterior side of the metal studs. An exterior wall 34 is illustrated as being spaced a short distance, such as 6 to 9 inches, from the one side of the metal studs 18 and 20, which normally would make it difficult to use a screw gun or hammer, to secure the metal strapping band to the exterior side of the metal studs 18 and 20. However, the installer merely may bend the tabs 28 and 32 with a pair of metal snips or pliers and bend them around the L-shaped section of the metal studs, to secure the metal band in the horizontal position. Angular tabs 24 and 26 are then bent angularly outwardly and perpendicular from the plane of the metal band. A flexible insulation material, such as a batt of fiberglass 36, is impaled on the projecting tabs 24 and 26, to retain the insulation in a nonsagging position between the metal studs.

Figure 3:
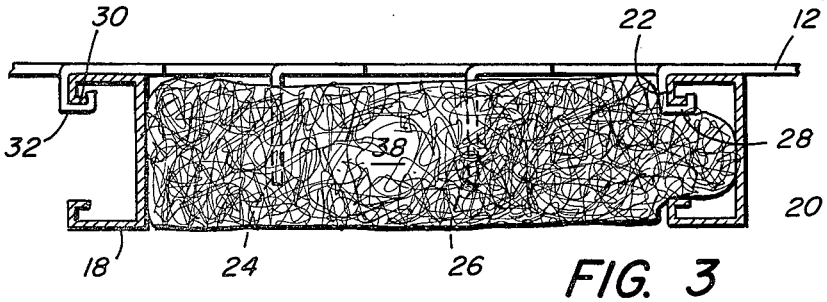
FIG. 3 is a top sectional view of insulation in a wall cavity supported by the metal strapping band.

FIG. 3 is a sectional top view of FIG. 2, with the insulation in place between the metal studs and retained in position by the projecting tabs 24 and 26, with the insulation projecting into the open channel of the metal stud 20, while angular tabs 28 and 32 retain the band in a horizontal position.

What is claimed is:

1. A method of supporting insulation in an upright position in a wall cavity between spaced-apart wall studs which define a plurality of wall cavities therebetween, which method comprises:

(a) securing an elongated metal strapping band spanning the plurality of wall cavities having a one and other end in a generally horizontal position to one face of the wall studs and extending therebetween, the one or other end extending beyond at least one wall stud, the metal strapping band characterized by having a plurality of uniformly spaced-apart lines of weakness thereof extending from and adjacent at least one edge thereof and extending between the one and other end, to define a plurality of defined tab elements in the plane of the strapping band and defined by the lines of weakness;

(b) bending at least one of the defined tab elements from the edge of the strapping band along the lines of weakness and extending the tab elements generally perpendicular from the plane of the metal strapping band and into at least one of the wall cavities; and (c) supporting insulation in the wall cavity by impaling the insulation upon the outwardly extended, defined tab elements.

2. The method of claim 1 wherein the defined tab elements comprise generally angular tabs having a sharp point.

3. The method of claim 1 wherein the wall studs comprise metal wall studs having a generally U-channel sectional form, and wherein at least one of the tab elements is secured about the one edge of the form.

4. The method of claim 1 wherein the insulation comprises flexible fiberglass layer material.

5. The method of claim 1 which includes bending outwardly at least two of the tab elements in each wall cavity, to support the insulation.

6. The method of claim 1 which includes securing the metal strapping band in a generally horizontal position, extending across a plurality of the wall cavities, wherein the wall studs comprise metal studs having an open, U-shaped channel, which method includes bending at least one tab element along the lines of weakness and about a lip of the open, U-shaped channel of the metal studding, to secure the metal strapping band in a generally horizontal position to the U-shaped channel of the metal studs.

7. The method of claim 1 which includes placing a plurality of metal strapping bands across the wall studs at defined horizontal positions, extending between the top and the bottom of the wall stud.

8. The method of claim 1 wherein the lines of weakness comprise a plurality of generally angular, parallel lines of weakness extending inwardly up to about 50% of the width of the strapping band.

9. The method of claim 1 wherein the lines of weakness are characterized by a series of perforations which permit the defined tab elements to be bent easily by the installer from the plane of the metal strapping band.

10. The method of claim 1 wherein the defined tab elements to be bent from the metal strapping band are generally triangular in shape, with the lines of weakness extending at an angle of from about 30 to 45 degrees inwardly from the edge of the strapping band.

11. A building comprising:

(a) a plurality of generally vertical, metal, U-channel wall studs having lip elements to define the U-channel and the wall studs, and to define a plurality of wall cavities between each pair of wall studs;

(b) at least one metal strapping band extending generally horizontally across more than one wall cavity, the metal strapping band characterized by a plurality of defined tab elements extending outwardly and generally perpendicular from the strapping band and into at least one wall cavity defined by the wall studs, the defined tab elements extending from the one of the outer edges of the metal strapping band;

(c) the metal strapping band retained in a generally horizontal position across the metal wall studs by at least one tab element of the metal strapping band bent around one of the lip elements of the U-channel wall studs; and (d) insulation in the wall cavity, the insulation retained in an upright position by being impaled on at least one of the outwardly bent tab elements within the wall cavity.

12. The building of claim 11 wherein:

(a) the metal strapping band extends generally horizontally across and between a plurality of wall studs a short distance from the top of the wall studs, the wall studs defining a plurality of wall cavities;

(b) the insulation in the plurality of wall cavities comprising a flexible type of sheet-insulation material subject to sagging, if not supported with the plurality of wall cavities;

(c) the metal strapping band supported horizontally by bending one tab element about the lip of a plurality of the U-channel metal wall studs; and (d) the insulation supported in a nonsag position in each wall cavity by at least two, generally triangular, sharp-pointed tab elements.

13. The building of claim 11 wherein the tab elements comprise generally triangular tab elements bent outwardly toward and into the wall cavities from a flat, metal strapping band characterized by a plurality of lines of weakness therein extending inwardly from the edge, to define the tab element to be bent from the strapping band.

14. The building of claim 11 which includes at least one metal strapping band extending generally horizontally across the top portion of a plurality of wall studs, with the metal strapping band retained in a horizontal position by at least one tab element secured to each of the wall studs across which the metal strapping band extends, and wherein at least two, generally triangular tab elements extend outwardly into each wall cavity, to support insulation.

15. The building of claim 11 which includes an exterior wall extending in a close proximity to the exterior plane of the wall studs, and wherein the metal strapping band extends generally horizontally across a plurality of pairs of wall studs between the exterior surface of the wall studs and the interior surface of the exterior wall of the building.

16. The building of claim 11 wherein the lines of weakness comprise a plurality of generally angular, parallel lines of weakness extending inwardly up to about 50% of the width of the strapping band.

17. The building of claim 11 wherein the defined tab elements to be bent from the metal strapping band are generally triangular in shape, with the lines of weakness extending at an angle of from about 30 to 45 degrees inwardly from the edge of the strapping band.

* * * * *